United States Patent [19]

Lauritsen et al.

[11] 4,297,552

[45] Oct. 27, 1981

[54] VACUUM SWITCH

[75] Inventors: Richard L. Lauritsen, Hoffman Estates; Panagiotis K. Mandellos, Chicago, both of Ill.

[73] Assignee: The Singer Company, Stamford, Conn.

[21] Appl. No.: 116,860

[22] Filed: Jan. 30, 1980

[51] Int. Cl.[3] ..... H01H 35/34

[52] U.S. Cl. ..... 200/83 P; 200/83 S

[58] Field of Search ..... 200/83 R, 83 P, 83 W, 200/83 S, 83 SA, 153 V

[56] References Cited

U.S. PATENT DOCUMENTS

| | | | |
|---|---|---|---|
| 2,813,944 | 11/1957 | Tyzack | 200/83 P |
| 3,110,784 | 11/1963 | Williams | 200/83 P |
| 3,230,328 | 1/1966 | Chapin | 200/83 P |
| 4,007,344 | 2/1977 | Hipple | 200/83 SA |

*Primary Examiner*—Gerald P. Tolin

*Attorney, Agent, or Firm*—Bayard H. Michael

[57] ABSTRACT

A vacuum switch in which the diaphragm movement with increasing vacuum is opposed by two springs which determine the vacuum required to actuate the switch. As the vacuum subsequently decreases one of the springs is rendered inoperative before the switch resets so the reset vacuum is determined by the one spring remaining effective. The spring which is rendered inoperative is compressed between the actuator and an eyelet which can seat on the actuator (spring ineffective) or the housing (spring effective) and which also functions to limit motion of the actuator relative to the eyelet so the switch operated by the actuator cannot be overstressed.

5 Claims, 10 Drawing Figures

VACUUM SWITCH

FIELD OF THE INVENTION

In order to improve fuel economy while still meeting the emission standards required by the Department of Transportation the automotive industry finds it necessary to have means for sensing the carburetor ported vacuum (indicative of throttle position) and effecting a switching function . . . a vacuum switch. The operating environment of the switch is severe . . . vibration, changing humidity, gasoline vapors and temperature ranging between −40° C. and 137° C. The industry requires the switch to operate in such an environment for 2,000,000 cycles without appreciable drift from the set trip and reset values with the millivolt drop across the switch contacts remaining low. And, of course, cost is an important factor.

BACKGROUND PRIOR ART

The prior art vacuum switches use a single spring with two adjusting screws for calibrating the trip and reset values. Since there is a limited travel distance between trip and reset the spring rate must be high and this causes the calibration to drift throughout the switch life.

SUMMARY OF THE INVENTION

The object of this invention is to provide a vacuum switch which meets the needs of the automotive industry (mentioned above) at low cost. This has been accomplished by using two springs determining the trip force with provision for rendering one spring ineffective before reset so the other spring determines the reset force. The one spring (called the trip spring hereafter) is connected to the actuator by means including an eyelet dimensioned to limit the travel of the diaphragm and the actuator which engages the actuating tongue of the switch blade. This minimizes overtravel of the tongue with consequent increase in blade life and also minimizes diaphragm wear. Since the dimensions of the actuator and the eyelet are easily controlled, low rate springs may be used and the finished switch need not be calibrated. The trip and reset vacuum settings drift less. Low rate springs allow force control which meets allowable vacuum setting tolerances. The vacuum switch can be made easily and efficiently and can be sold at a low price.

DESCRIPTION OF THE PREFERRED EMBODIMENT

Figure 1:
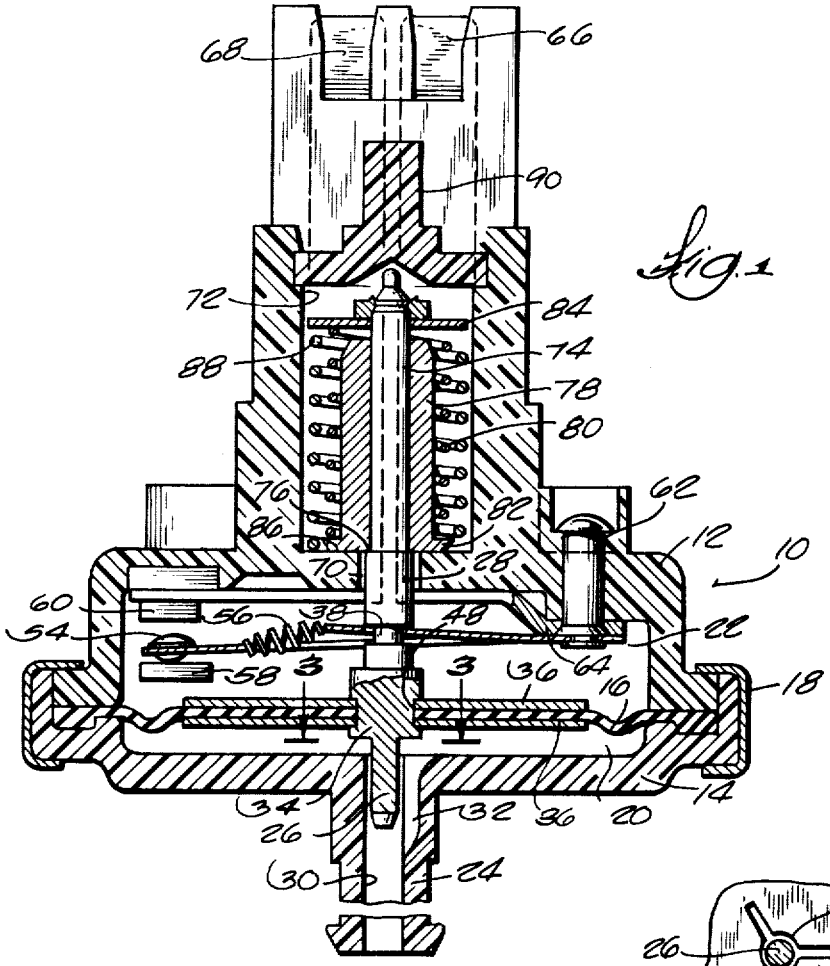
FIG. 1 is a vertical section through the vacuum switch.
Figure 3:
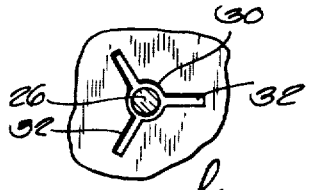
FIG. 3 is a fragmentary horizontal section taken on line 3—3 in FIG. 1.
Figure 2:
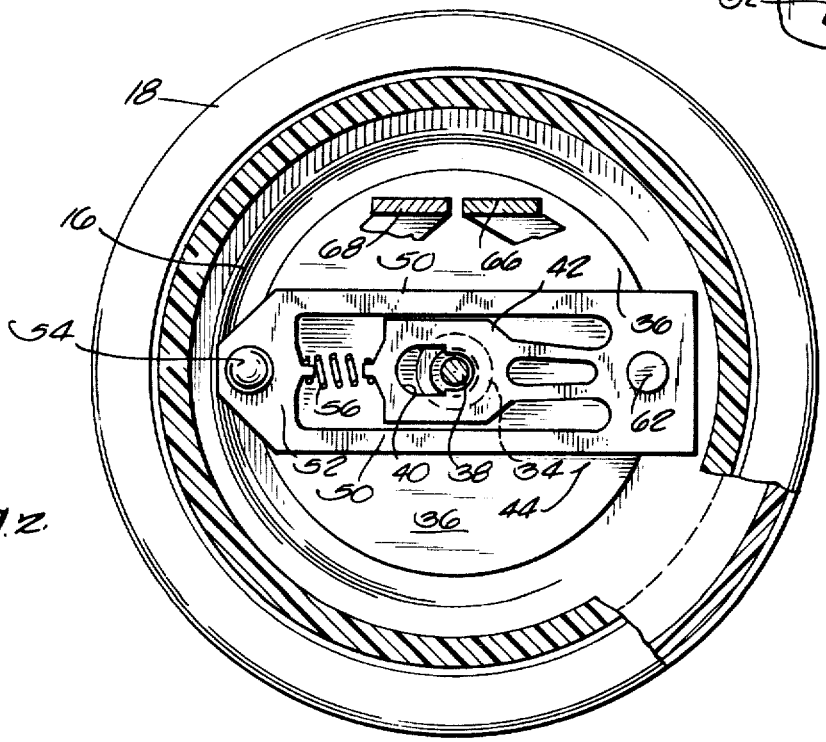
FIG. 2 is a horizontal section looking down on the switch.
Figure 4:
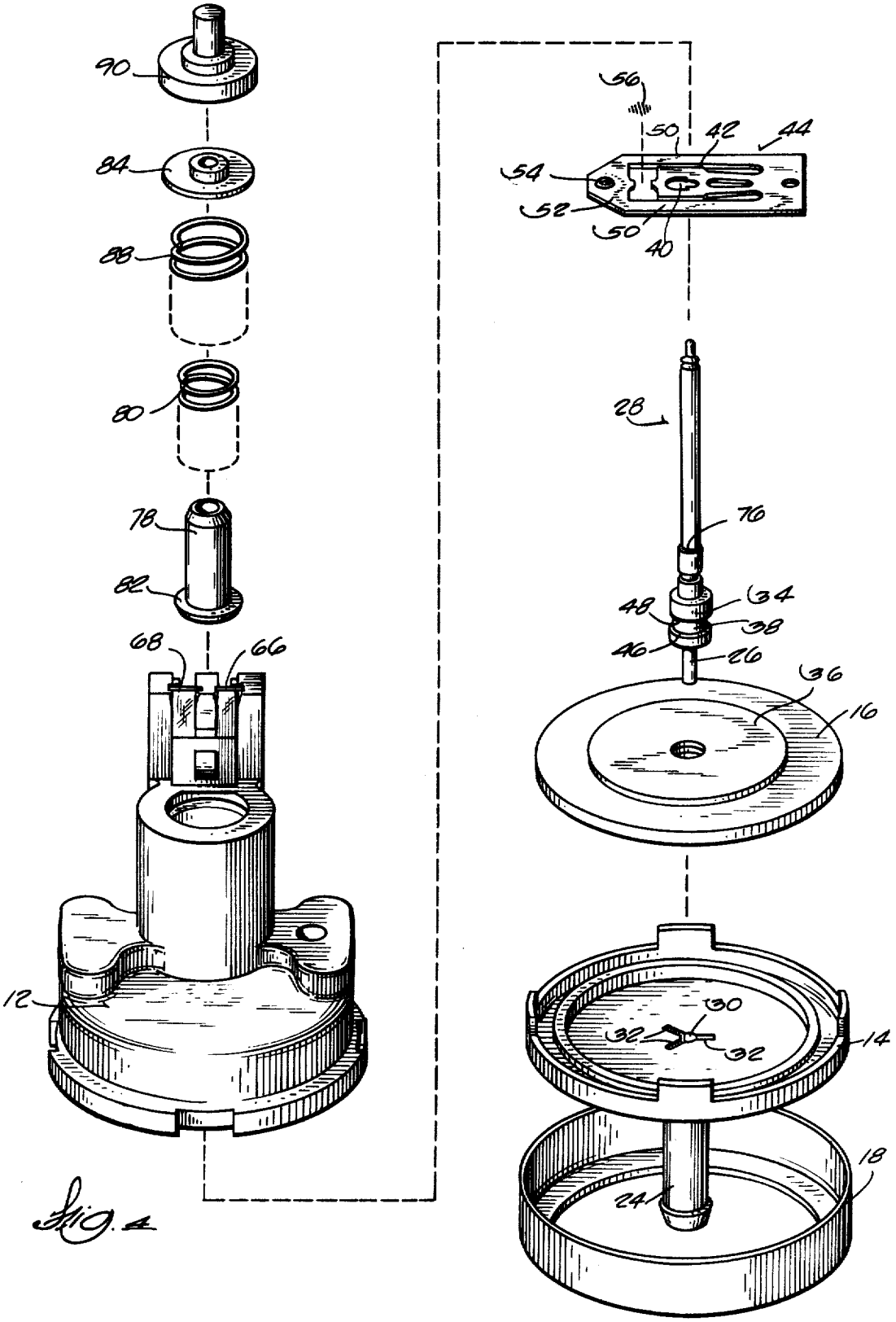
FIG. 4 is an exploded perspective view of the vacuum switch.

In the following description, reference will be made to the vacuum in the vacuum chamber as causing movement of the diaphragm. It will be appreciated that, in fact, it is atmospheric pressure acting on the other side of the diaphragm which causes the diaphragm to move as the vacuum increases . . . that is, as the absolute pressure in the vacuum chamber decreases.

The vacuum switch housing 10 is made up of an upper portion 12 connected to lower portion 14 with the perimeter of diaphragm 16 clamped between the two housing portions retained together by the ring 18 formed over the rims of the housing portions. Diaphragm 16 divides the interior of the housing 10 into a vacuum chamber 20 and a switch chamber 22. The vacuum chamber 20 is connected to a vacuum source via a tube (not shown) leading from bored nipple 24. The lower end 26 of actuator 28 is received inside the bore 30 of nipple 24 to guide the lower end of the actuator. It will be noted that bore 30 is enlarged with three radial passages 32 insuring free venting past the lower end 26 of the actuator so as to insure proper response in the vacuum chamber 20. The actuator is secured to diaphragm 16 by forming the portion 34 over the diaphragm pad discs 36, 36 secured on opposed sides of the diaphragm. Thus, movement of the diaphragm will move the actuator.

The reduced diameter portion 38 of the actuator 28 passes through the narrow portion of the key slot aperture 40 in the actuating tongue 42 of switch 44 with the actuator shoulders 46, 48 adjacent the reduced diameter portion 38 being spaced to allow the switch tongue a range of movement relative to the actuator. The switch 44 includes the side rails 50, 50 connecting the base of the blade to the end 52 provided with contact 54. Barrel spring 56 is compressed between the end of tongue 42 and the end of blade 52 to bias the blade and the contact carried by the blade in the direction opposite the disposition of the tongue. Thus, in FIGS. 1 and 5 the movable contact 54 on the blade is in engagement with the lower contact or stop fixed in the switch chamber 22. Stop 58 for contact 54 can serve either as a stop or a contact. If the member 58 is not required for switching functions, then it is provided to limit the travel of the end of the blade 52.

Figure 6:
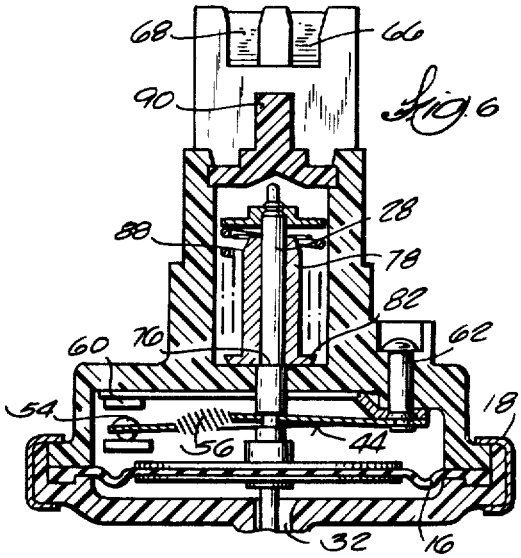

Starting with the position shown in FIGS. 1 and 6, if the actuator moves down to move the tongue 42 downwardly, the end of the tongue will pass over center causing the barrel spring to go over center to snap the free end of the blade and the associated contact 54 upwardly into engagement with the upper contact 60. The fixed end of the switch 44 is riveted in the housing at 62 and is provided with a buss 64 leading via a route not important here to the terminal 66 while the contact 60 is similarly bussed internally to terminal 68.

It will be noted the actuator 28 passes through an aperture 70 in the housing and projects upwardly into cavity 72. The upper portion 74 of the actuator is reduced above shoulder 76 and has eyelet 78 mounted thereon with trip spring 80 compressed between the eyelet flange 82 and retainer 84 fixed on the upper end of the actuator so the flange either seats on the actuator shoulder 76 or on the bottom surface 86 of the cavity 72. When the parts are positioned as in FIG. 5 with the flange seated on shoulder 76, the force of the trip spring 80 acts upwardly on the retainer, (and, hence, the actuator) and downwardly on the actuator shoulder to cancel out the effect of the trip spring.

Reset spring 88 is of larger diameter than the eyelet flange and seats on cavity surface 86 and on retainer 84 so that its force always acts in an upward direction on the retainer and actuator. The cavity is closed by plug member 90. Chamber 22 is vented to atmospheric pressure through the clearance and between terminals 66 and 68 and the body.

Figure 5:
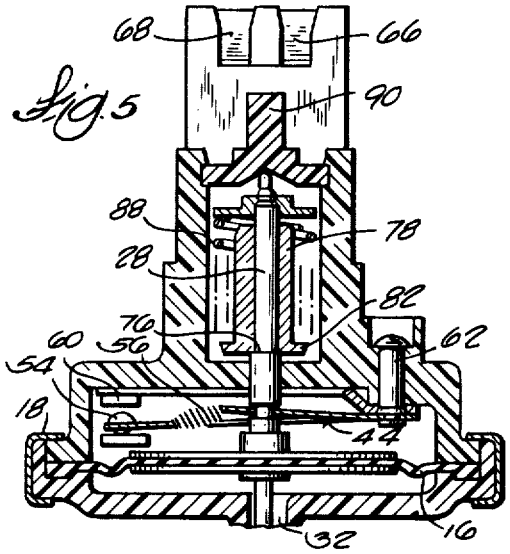
FIGS. 5 through 10 are partially schematic views showing the sequence of operation.
Figure 7:
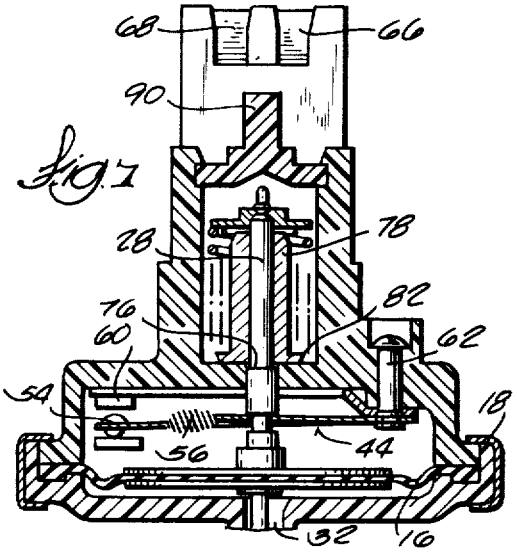
Figure 8:
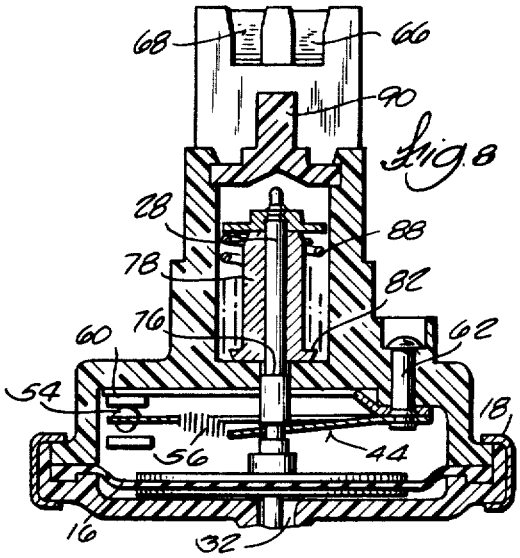

Starting with the position shown in FIG. 5, as the vacuum in chamber 20 increases, the actuator will move down and the eyelet flange will engage the cavity surface 86 as shown in FIG. 6. Any further movement from this point results in the trip spring becoming effective to exert an upward force on the retainer (and actuator) in addition to the force of reset spring 88. Therefore, the vacuum in the chamber 20 must overcome both springs to continue downward movement of the diaphragm and actuator. This will move the actuator shoulder downwardly from the eyelet as in FIG. 7 until the switch tongue passes over center whereupon the switch blade will snap upwardly to the position as shown in FIG. 8. The tubular portion 78 of the eyelet is of such length that it will be engaged by retainer 84 shortly after the blade trips and passes over center. This will prevent further downward movement of the actuator even if the vacuum in the vacuum chamber increases. The retainer and actuator are prevented from further downward movement because the eyelet is solid against the housing. This prevents overtravel of the switch tongue as well as preventing undue stress on the diaphragm. This, in turn, results in long switch life and long diaphragm life. Indeed, this vacuum switch has been cycled 3.5 million times with no diaphragm failure.

Figure 9:
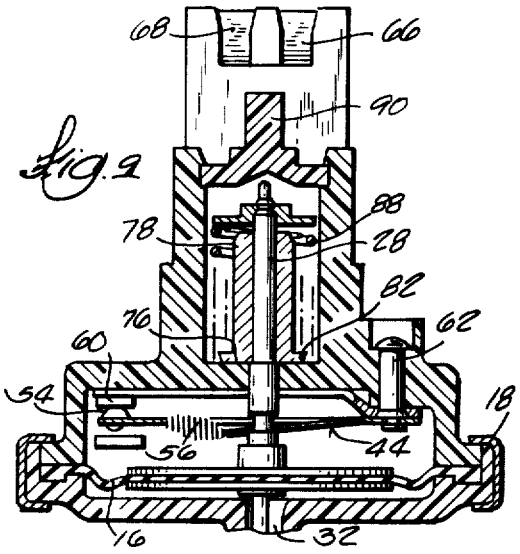
Figure 10:
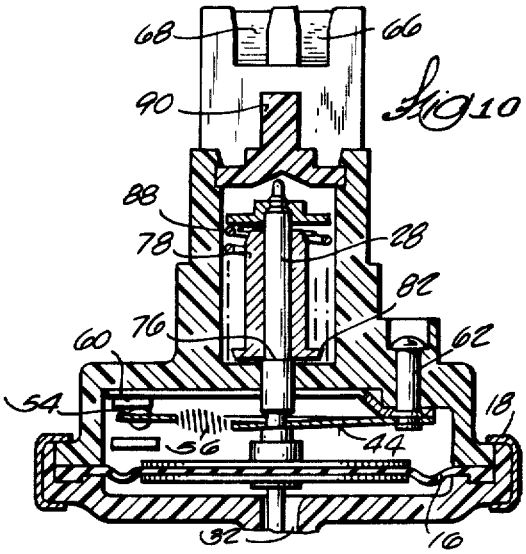

As the vacuum decreases from the condition shown in FIG. 8, the actuator will start moving upwardly until the shoulder 76 on the actuator engages the eyelet as shown in FIG. 9 and it will be noted that the blade has not been snapped back over center to reset the switch. Upon engagement of the shoulder with the eyelet flange, the force of the trip spring 80 is again cancelled out and now the pressure in the vacuum chamber is opposed by the reset spring 88 only. Further upward movement to the position shown in FIG. 10 picks up the eyelet with the trip spring force being cancelled. As illustrated in FIG. 10, the switch is ready to go over center and reset. Slight further upward movement of the diaphragm and actuator will reset the switch to the position shown in FIG. 5.

It will be appreciated the reset value is determined only by the reset spring 88 while the trip value is determined by the cumulative effect of both springs 80, 88. Since two low rate springs are used in this design and their force and the trip and reset positions are readily controlled, there is no need to calibrate the vacuum switch after assembly. The eyelet prevents switch overtravel, prevents diaphragm overtravel, and prevents overcompression of the springs. This results in long switch life with higher contact force than possible in the prior art single spring systems through a greater range of vacuum. Diaphragm life is increased. The cost of the low rate springs is attractive. The eyelet and the actuator are the parts which determine the stroke and other critical characteristics and these are screw machine parts, the dimensions of which can easily be controlled accurately.

We claim:

1. A vacuum switch having a housing enclosing a chamber divided by a diaphragm into a vacuum chamber and a switch chamber, a conduit leading from the vacuum chamber for connection to a variable vacuum source, a switch in the switch chamber and having a switch blade provided with a contact moveable between a normally closed and normally open fixed contacts and having a tongue which is moved to cause movement of the blade with a snap action, an actuator connected to said diaphragm and to said tongue and extending through an aperture in the housing, characterized by, a spring retainer fixed on the outboard end of the actuator, a reset spring bearing against and compressed between the retainer and the housing, said actuator having a shoulder thereon in the region of the actuator passing through the housing aperture, a tubular eyelet slidably mounted on the actuator between said shoulder and the outboard end of the actuator and having a flange engageable with the shoulder and extending beyond the aperture so as to be engageable with the outside of the housing, a trip spring bearing against and compressed between said flange and said retainer, said trip spring being effective to exert a force on the actuator via the retainer when said flange is in engagement with the housing and being ineffective to exert such a force when the flange is in engagement with said shoulder.

2. A vacuum switch according to claim 1 in which the actuator is so dimensioned relative to the engagement with the switch and said shoulder that the force opposing the vacuum force on the diaphragm to trip the switch from the normally closed to the normally open contact is the combined force of both springs and the force opposing the vacuum force on the diaphragm to reset the switch is the force of the reset spring only.

3. A vacuum switch according to claim 2 in which the length of the tubular portion of the eyelet functions to limit travel of the actuator under increasing vacuum.

4. A vacuum switch having a housing enclosing a chamber divided by a diaphragm into a switch chamber and a vacuum chamber adapted for connection to a variable vacuum source, an over center snap acting switch mounted in the switch chamber and having a moveable contact normally engaging a first fixed contact and moveable into engagement with a second fixed contact when the switch is actuated over center, an actuator interconnecting the diaphragm and the switch, said actuator including a retainer on its outer end, a spring bearing against the retainer and biasing the actuator in opposition to actuator movement in response to increasing vacuum, the improvement comprising, a second spring, a shoulder on the actuator, a spring seat slidably mounted on the actuator and engageable with the shoulder, said second spring bearing against and compressed between the retainer and the seat whereby the force of the spring is ineffective when the seat engages the shoulder, an abutment fixed in the housing engaged by the seat as the actuator moves in response to increasing vacuum whereby the actuator moves relative to said seat and continued movement of the actuator is opposed by the force of the second spring in addition to the force of the first spring, said abutment being engaged by the seat before the switch is tripped over center from its normal engagement with the first fixed contact, said seat being re-engaged by the shoulder and moved off said abutment before the switch is actuated over center to move the switch contact from engagement with the second fixed contact whereby the vacuum required to reset the switch is determined only by the first spring.

5. A vacuum switch according to claim 4 in which the spring seat has a limited motion connection to the actuator whereby motion of the actuator relative to the seat is limited after the seat engages said abutment and overtravel of the spring is prevented.

* * * * *